US009903039B2

(12) United States Patent
MacNeil

(10) Patent No.: US 9,903,039 B2
(45) Date of Patent: Feb. 27, 2018

(54) ELECTROCHEMICAL DEPOSITION CHAMBER

(71) Applicant: PICOFLUIDICS LIMITED, Cardiff (GB)

(72) Inventor: John MacNeil, Cardiff (GB)

(73) Assignee: SPTS Technologies Limited, Newport (GB)

( * ) Notice: Subject to any disclaimer, the term of this patent is extended or adjusted under 35 U.S.C. 154(b) by 718 days.

(21) Appl. No.: 14/218,051

(22) Filed: Mar. 18, 2014

(65) Prior Publication Data

US 2014/0284216 A1 Sep. 25, 2014

(30) Foreign Application Priority Data

Mar. 18, 2013 (GB) ..... 1304901.0

(51) Int. Cl.

| | |
|---|---|
| ***C25B 9/00*** | (2006.01) |
| ***C25D 7/00*** | (2006.01) |
| ***C25D 17/00*** | (2006.01) |
| ***C25D 5/08*** | (2006.01) |
| ***C25D 21/00*** | (2006.01) |
| ***C25F 7/00*** | (2006.01) |
| ***C25D 17/02*** | (2006.01) |
| ***C25D 21/10*** | (2006.01) |

(52) U.S. Cl.

CPC ..... *C25D 21/00* (2013.01); *C25D 17/001* (2013.01); *C25D 17/004* (2013.01); *C25D 17/02* (2013.01); *C25D 21/10* (2013.01); *C25F 7/00* (2013.01)

(58) Field of Classification Search

CPC .. C25B 9/00; C25D 5/08; C25D 17/02; C25D 17/00; C25D 7/00

USPC ..... 204/275.1

See application file for complete search history.

(56) References Cited

U.S. PATENT DOCUMENTS

| | | | |
|---|---|---|---|
| 5,853,559 | A | 12/1998 | Tamaki et al. |
| 6,077,412 | A | 6/2000 | Ting et al. |
| 6,156,167 | A | 12/2000 | Patton et al. |
| 6,800,187 | B1 | 10/2004 | Reid et al. |
| 7,118,658 | B2 | 10/2006 | Woodruff et al. |
| 7,445,697 | B2 | 11/2008 | Keigler et al. |
| 7,690,324 | B1 | 4/2010 | Feng et al. |

(Continued)

FOREIGN PATENT DOCUMENTS

| | | | |
|---|---|---|---|
| WO | 00/26443 | A2 | 5/2000 |
| WO | 2008137951 | A2 | 11/2008 |
| WO | 2012080716 | A2 | 6/2012 |

OTHER PUBLICATIONS

European Search Report for EP14159870.

*Primary Examiner* — Zulmariam Mendez

(74) *Attorney, Agent, or Firm* — McNees Wallace & Nurick LLC

(57) ABSTRACT

According to the invention an electrochemical deposition or polishing clamber including:

a support for a substrate, the support having an in-use position;

a housing having an interior surface and a fluid outlet pathway for removing an electrolyte from the chamber, wherein the fluid outlet pathway includes one or more slots which extend into the housing from at least one slotted opening formed in the interior surface;

a seal for sealing the housing to a peripheral portion of a surface of a substrate position on the support in its in-use position; and (Continued)

a tilting mechanism for tilting the chamber in order to assist in removing electrolyte from the housing through the fluid outlet pathway.

11 Claims, 2 Drawing Sheets

(56) References Cited

U.S. PATENT DOCUMENTS

| | | | |
|---|---|---|---|
| 8,029,653 | B2 | 10/2011 | Yamamoto et al. |
| 8,147,660 | B1 | 4/2012 | Mayer et al. |
| 2004/0022940 | A1 | 2/2004 | Nagai et al. |
| 2006/0113192 | A1 | 6/2006 | Kurashina et al. |

ELECTROCHEMICAL DEPOSITION CHAMBER

This invention relates to an electrochemical deposition chamber, and to associated methods of electrochemical deposition. The invention applies also to electrochemical polishing.

Electrochemical deposition (ECD) is an important technique in the manufacture of semiconductor devices and components, hard disk drive fabrication, and other applications. With the recent growth of interest in 3D integration of wafers, there is a developing interest in providing conductive layers in through silicon vias (TSVs). One of the most promising candidates for depositing conductors in features greater than 1 micron in diameter and less than 10:1 aspect ratio is electrochemical deposition of copper. Because of the relatively large feature sizes associated with this type of implementation scheme in comparison with conventional interconnects in logic or memory devices, long cycle times in the deposition tools are required. For productivity reasons, it is desirable to reduce the cycle times of the process equipment and to make the tools as efficient as possible.

In electrochemical deposition of copper (ECD Cu) in semiconductor applications, a wafer is placed in an electrolyte (typically an aqueous solution of CuSO4/H2SO4 plus small quantities of organic additives) and a DC potential (or pulsed DC) is applied between an immersed Cu electrode (anode) and a continuous Cu seed layer (cathode) on the wafer being coated. The inverse of this approach—electropolishing—can also be carried out to remove Cu from the surface of a wafer by making the wafer surface the anode and the corresponding electrode the cathode.

Due to the high value of semiconductor wafers it is desirable to ensure that as much as possible of the wafer surface is used. To achieve this aim for deposition or electropolishing processes a highly uniform coating is required to cover the wafer surface as close as possible to the edge of the wafer. The area at the edge of the wafer which is not intended to be used is commonly known as the region of edge exclusion. This is defined as a band "x" mm from the edge of the wafer. The size of the edge exclusion zone is wafer size and process dependent.

Automated ECD systems typically use a handling robot to move wafers from the load/unload station from cassettes/FOUPS to a pre-clean station followed by one or more ECD deposition stations and ultimately a post deposition clean station before returning to the cassette/FOUP. In conventional ECD stations the wafer is immersed in the electrolyte and electrical contact to the wafer surface is achieved by contacts to the wafer edge. A fluid seal also made to the wafer surface and typically this seal protect the wafer contacts from contact with electrolyte. Two generic approaches are typically used—horizontal (wafer face to be coated facing down) "Fountain cells" and vertical "Rack" systems.

Fountain cell systems, where the electrolyte is sprayed vertically at a wafer rotating face down in a plating bath, retain the wafer in a clamshell type fixture which provides a fluid seal and electrical contact to the wafer surface. U.S. Pat. No. 6,156,167 and U.S. Pat. No. 7,118,658 disclose systems of this type. The clamshell is loaded and unloaded at the ECD cell, typically automatically with a wafer transport robot. This load/unload cycle occurs outside the electrolyte. Once the fixture is loaded it is then immersed into a tank of electrolyte which contains the submerged anode assembly.

In vertical rack type systems such as disclosed in U.S. Pat. No. 8,029,653 and U.S. Pat. No. 7,445,697, another variant of a clamshell type fixture is used. This fixture is not required to rotate however one fixture must move from one process station to the next before it is finally opened prior to leaving the tool. While this reduces the number of times the edge seal/contact must be made it does complicate the pre and post deposition steps.

An alternative approach to ECD has been suggested by U.S. Pat. No. 6,077,412, U.S. Pat. No. 5,853,559 and WO 2012/080716, where the wafer is placed horizontal parallel with the anode as in "Fountain cell" arrangement but this time the surface to be coated is facing up. The challenge with this type of arrangement is to minimize the loss of electrolyte from the system as when the cell is opened and quantity of electrolyte flows over the edge of the wafer. The lost electrolyte adds to cost (as it must be replaced) but also acts as a source of contamination for subsequent process steps.

Whilst a conventional clamshell type enclosure could be used in the type of arrangement there are significant costs associated with such an approach—not least the need for automated closure/opening of the clamshell and a further requirement for a seal between the clamshell and the electrolyte cavity. What is needed is a cost effective closure and fluid removal mechanism. Desirably, such a mechanism would enable the low volume cavity cell described in WO2012/080716 to be realized without the complications and additional costs associated with prior art approaches.

For a low volume cavity ECD cell to operate productively the amount of fluid entering and leaving the system must be minimized while a reliable fluid seal and electrical contact is made to the wafer surface very close (preferably within about 2 mm) to the edge of the wafer. Care must be also taken to ensure bubbles or trapped pockets of air/N2/gas can readily leave the cell as these can have a detrimental effect on film uniformity.

Fluid transport into/from the cell can be achieved by a pressure gradient eg. a gas purge or a pump. However one of the key challenges for this type of low volume cell is to provide a means of removing the electrolyte from the cell in such a fashion that no electrolyte flows beyond the edge of front surface of the wafer when the cell is opened. This is desirable as when electrolyte progresses beyond the edge of the wafer it will contaminate the backside of the wafer, the platen top and any transport mechanism that comes in contact with the electrolyte.

In the clamshell approaches adopted in fountain cells and rack based cells a containment fixture which seals the wafer edge, provides electrical contact and is used to transport the wafer to/from the bath of electrolyte. Electrolyte can be removed from the wafer surface with the fluid seal in place outside the plating cell.

In U.S. Pat. No. 6,077,412, the disclosed system is designed for the wafer to be cleaned in situ within the plating chamber by means of deionised water rinse and spin dry. In this case a relatively large volume chamber is used to contain the electrolyte, and fluid removal is achieved by lowering the wafer support plate. Fluid will be removed from the system rapidly; however the fluid will flow over the edge of the wafer. This necessitates an in situ clean and a large vessel outside the plating cell providing the secondary containment region. Whilst fluid removal may be aided for recycling purposes by small pipes, these will not be sufficient to avoid the in situ clean and the secondary containment region as relatively large amounts of fluid will remain on the wafer surface when the chamber is opened.

In U.S. Pat. No. 5,853,559, it is suggested to use a small tube close to the surface of the wafer to reduce the amount of electrolyte left on the wafer surface (and increase the amount re-cycled) prior to a deionised water rinse of the remaining fluid.

Both U.S. Pat. No. 6,077,412 and U.S. Pat. No. 5,853,559 disclose systems where the volume of the chambers is large, i.e., the wafer to anode separation is equal to or greater than the wafer width. Also, the present inventors have realised that the use of tubes and pipes is undesirable, because they can interfere with dielectric properties of the chamber and they can impose restrictions on fluid removal rates.

The present invention, in at least some of its embodiments, addresses the above described problems, needs and desires.

According to a first aspect of the invention there is provided an electrochemical deposition or polishing chamber including:

a support for a substrate, the support having an in-use position;

a housing having an interior surface and a fluid outlet pathway for removing an electrolyte from the chamber, wherein the fluid outlet pathway includes one or more slots which extend into the housing from at least one slotted opening formed in the interior surface;

a seal for sealing the housing to a peripheral portion of a surface of a substrate position on the support in its in-use position; and a tilting mechanism for tilting the chamber in order to assist in removing electrolyte from the housing through the fluid outlet pathway.

The fluid outlet pathway may include a slot which is in communication with a slotted opening and extends generally upwardly therefrom.

The slotted opening may be formed in the interior surface so as to face downwardly into the chamber. This arrangement can provide numerous advantages. It allows the opening to be formed close to the surface of the substrate whilst allowing enough room to locate the seal. This arrangement works particularly well in combination with the preferred seal of the invention. Also, rapid removal of the electrolyte is possible because on tilting a relatively large opening cross section is presented. Further, it is generally undesirable to obscure the substrate with a dielectric material. Arrangements wherein the slotted opening is formed in the interior surface so as to face downwardly into the chamber allows such obscuring of the substrate to be minimised. The interior surface may include an overhanging section. The slotted opening may be formed in the overhanging section.

Conveniently, the housing includes a lower housing portion and an upper housing portion which are spaced apart to define at least one slot and, optionally, at least one slotted opening. The upper housing portion may be a shroud member which is positioned over the lower housing portion.

Advantageously, the seal is an annular seal having an outer surface which is downwardly inclined towards the interior of the chamber. The annular seal may taper to a sealing surface for sealing against the surface of the substrate. The sealing surface may be an edge region formed at the intersection of two mutually inclined surfaces of the annular seal.

The annular seal may be funnel shaped.

In-use, the seal contacts the substrate at a level. The slotted opening may be disposed less than 5 mm above said level. It is possible to dispose the slotted opening at 3 mm or less above said level. Embodiments in which the slotted opening is disposed 1-2 mm above said level are possible.

Advantageously the seal is disposed so that, in-use, the seal contacts a peripheral portion of the surface of the substrate which is less than 3 mm from an edge of the substrate. The seal may contact, in-use, a peripheral portion of the surface of the substrate which is less than 2.5 mm, preferably in the range 1-2 mm, from the edge of the substrate.

The chamber may include an electrode disposed within the chamber and an electrode contact for contacting the substrate when the support is in its in-use position. For an electrochemical deposition chamber, the electrode is the anode and the electrode contact makes contact with the substrate in-use so that the substrate acts as a cathode.

For an electrochemical polishing chamber, the electrode is the cathode and the contact electrode makes contact with the substrate in-use so that the substrate acts as an anode.

When the support is in its in-use position, the separation between the substrate and the electrode may be less than 40 mm, and preferably is in the range 5 to 30 mm.

The tilting mechanism may be of any suitable kind. It may be a mechanical or electromechanical mechanism. In some embodiments, the tilting mechanism includes an actuator which is coupled to the chamber to cause tilting of same.

The removal of electrolyte from the chamber may be assisted using known means such as by chamber pressurisation or pumping of the chamber.

According to a second aspect of the invention there is provided an electrochemical deposition or polishing chamber including:

a support for a substrate, the support having an in-use position;

a housing having an interior surface and a fluid outlet pathway for removing an electrolyte from the chamber; and a seal for sealing the housing to a peripheral portion of a surface of a substrate position on the support in its in-use position;

in which the seal is an annular seal having an outer surface which is downwardly inclined towards the interior of the chamber.

According to a third aspect of the invention there is provided a method of removing electrolyte from an electrochemical deposition or polishing chamber including the steps of:

providing a chamber according to the first aspect of the invention;

using an electrolyte to perform an electrochemical deposition or polishing process on a substrate positioned on the support; and tilting the chamber in order to assist in removing electrolyte from the housing through the fluid outlet pathway.

Conveniently the chamber is tilted by less than 10°. With chambers of the invention, a relatively modest tilt of this kind can result in substantial removal of electrolyte from the chamber. The amount of electrolyte remaining can be reduced to negligible levels. In particular, the amounts of electrolyte remaining in the chamber can be reduced to a level where the substrate can be removed from the chamber with no electrolyte reaching the edge of the substrate. The chamber may be tilted by less than 10° with satisfactory results. In some embodiments, the chamber is tilted by 6° or less.

Whilst the invention has been described above, it extends to any inventive combination of the features set out above, or in the following description, drawings or claims. For example, the invention extends to any combination of features described in the different aspects of the invention set out above, eg, any feature described in reference to the first aspect of the invention is also provided in combination with any feature of the second and/or third aspects of the invention.

Embodiments of chambers in accordance with the invention will now be described with reference to the accompanying drawings, in which.

Figure 1:
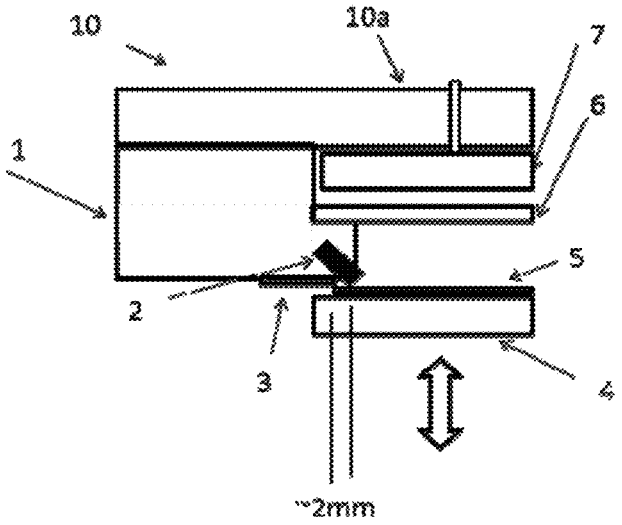
FIG. 1 is a semi-schematic cross section of a portion of a first embodiment of a chamber of the invention.

FIG. 1 shows a first embodiment of a chamber of the invention, depicted generally at 10. The chamber 10 is an electrochemical deposition chamber for processing a substrate 5. The substrate 5 is placed on a platen 4 either by hand or by mechanical means. The platen 4 is raised to compress an elastomeric seal 2 on the upper surface of the substrate 5 to form a fluid seal. At the same time as the fluid seal is being made, electrical contact is made with a seed layer on the upper surface of the substrate 5 by means of conductive springs 3. The seal 2 and conductive springs 3 are retained in a lower chamber body 1. As explained in more detail below, an advantage of the present invention is that it is possible to make contact within 1-2 mm of the edge of the substrate 5.

A soluble anode 7, which could be Cu or phosphorized Cu for Cu deposition, is located parallel with the wafer surface at or near to the top of the chamber 10. Electrical connections to the anode 7 and fluid connections to the chamber cavity are made through an upper chamber plate 10*a*. Additional fluid connections are made through the lower chamber body 1 as can be seen in FIG. 2. In certain configurations it is desirable to have a membrane/filter assembly 6 to assist fluid distribution and manage particulates between the substrate 5 and the anode 7. Representative but non-limiting separation distances from the substrate to the anode are ~5-30 mm for a system configured for 300 mm wafers.

Figure 2A:
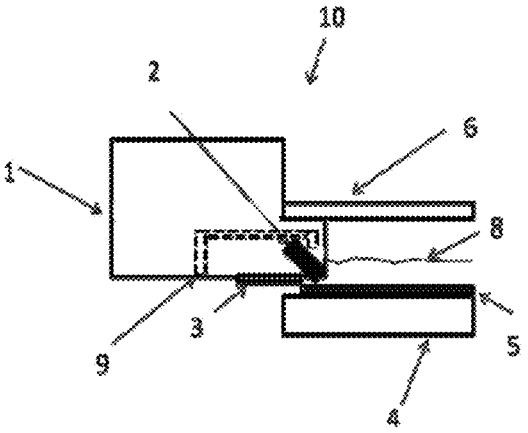
FIG. 2 is a further semi-schematic cross section of a portion of the first embodiment (a) in a horizontal configuration and (b) in a tilted configuration.
Figure 2B:
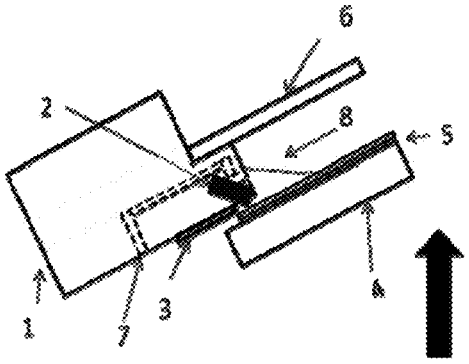

As shown in FIG. 2*a*), the chamber 10 comprises a fluid outlet pathway 9 which includes an arrangement of slots. When evacuating the electrolyte 8 from the cell it is not possible to remove fluid which lies below the lowest point of the fluid outlet pathway 9 as can be seen in FIG. 2 *a*). Even if the outlet point can be maintained 2 mm above the elastomeric seal, about 140 mL of fluid for a 300 mm wafer remains in the cell (see Table 1). Upon opening the cell some of the electrolyte 8 will be lost over the edge of the wafer and contaminate the chamber hardware. It is likely that this fluid will be costly to be reclaimed/recycled and hence is likely to be lost.

TABLE 1

Remaining fluid volume for 2 mm edge exclusion with 1 and 2 mm outlet height.

| Diameter of wafer (cm) | Edge excl (cm) | Height of outlet (cm) | Fluid vol (cm3) |
|---|---|---|---|
| 30 | 0.2 | 0.2 | 139.49 |
| 30 | 0.2 | 0.1 | 69.74 |

By tilting the cell by ~5° for a 300 mm wafer the amount of fluid remaining in the cell can be reduced to ~2 mL even for the situation when the outlet lies 2 mm above the wafer plane. When the wafer is returned to the horizontal position the wafer can be removed with no fluid reaching the edge of the wafer. This approach works for fluids on hydrophobic and hydrophilic surfaces. Following the electrochemical deposition step when the DC field is removed and the electrolyte is removed from the cell the tilt procedure is employed to ensure that all but the last few mL of electrolyte can be reclaimed/recycled. Depending on the process sequence required the wafer can be either removed and cleaned at another station on the tool or potentially on another system or a post deposition cycle could be carried out in the cell such as a DI water rinse. If the rinse sequence is employed the small amount of electrolyte would be once again lost from the electrolyte reservoir.

It should be noted that conventional "O" ring seals are not well suited for this arrangement. Even with a 1 mm cross section "O" ring, due to the fact that the "O" ring must be retained in position laterally and maintain its contact with the chamber wall it is very difficult to meet the desired edge exclusion goal of ~2 mm from the wafer edge. The edge electrical contact cannot interfere with the fluid seal. Without some form of active retention it is unlikely that an "O" ring could be expected to remain attached to the chamber. It is for this reason that a generally frustro-conical elastomeric seal 2 is used. Due to its shape, a seal of this kind will not fall out of the chamber due to gravity or surface tension with the surface of the wetted wafer. Also it provides simpler access for the electrical contacts and the exhaust fluid channel. The seal 2 is not a true frustro-conical shape, principally due to the presence of two mutually inclined surfaces which intersect to form a sealing edge. The seal 2 can fit into a slot. Conveniently, the slot can be formed by milling. Alternatively, the seal 2 can be retained in place by a washer.

Figure 3:
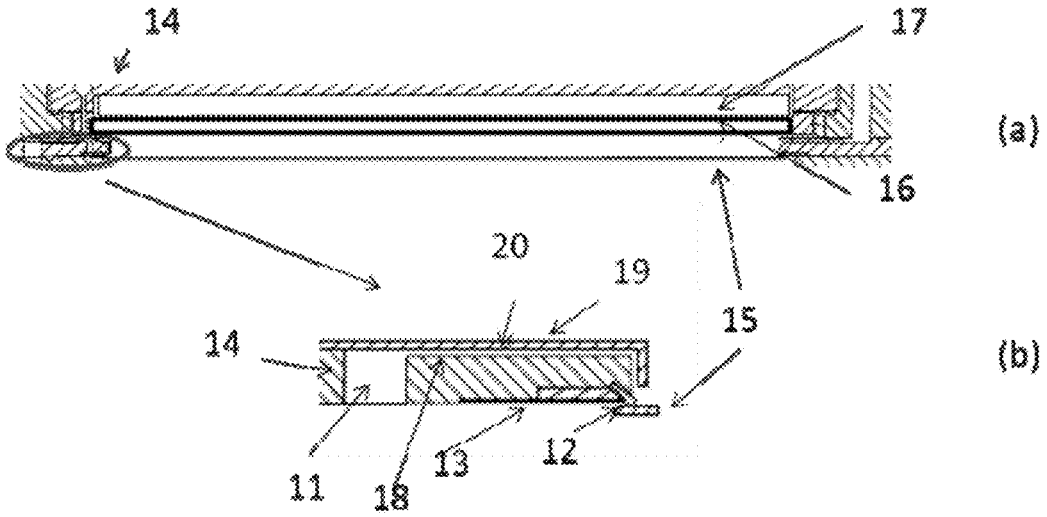
FIG. 3 shows (a) a cross sectional view of a second embodiment of a chamber of the invention excluding the substrate support and (b) shows the circled portion of (a) in greater detail.

A preferred embodiment of a chamber 14 is shown in FIGS. 3 (*a*) and (*b*). A cross section of a chamber cavity is shown in FIG. 3(*a*) where an anode 17 is situated above a membrane assembly 16 and a wafer 15 is situated within the chamber 14. The detail in FIG. 3(*b*) shows a fluid inlet/outlet path formed between a shroud 19 and features in the lower portion of the chamber 14. A slot 20 is cut into a lower chamber wall 18 and the shroud 19 brings the opening down close to the wafer surface. By judicious choice of slot width, cross section and depth (height above wafer surface) a high conductance flow path can be achieved without interfering with the edge exclusion uniformity constraints. The use of one or more slots is much more preferable to the use of a tube or tubes as the slot can cover a large fraction of the perimeter of the chamber wall while minimizing potential screening at the edge of the wafer.

As can be seen in FIG. 3(*b*) the wafer contact springs 13 are situated concentrically with the fluid seal 12 and the wafer 15. The seal 12 may be identical to the seal 2 described in relation to FIGS. 1 and 2. A recess 11 is formed in the lower chamber wall 10 to meet the slot 20. The recess 11 may itself be a further slot formed in the lower chamber wall 19. A lower opening of the recess is in communication with a fluid exhaust channel (not shown).

Typical materials used for the chamber construction are PEEK (polyetheretherketone), HDPE (high density polyethylene), PVC (polyvinyl chloride) or similar dielectric materials that can provide the necessary mechanical properties while being compatible with the electrolyte.

The present invention can provide a number of significant advantages. For example, the invention can be implemented as a low volume chamber. Also a very high proportion of the fluid can be re-cycled due to the fact that a very small amount of residual fluid is left in the chamber. Due to the low volume of the cell and the close proximity of the fluid path to the wafer surface a small amount of tilt of about 5° is sufficient to ensure effective removal of the electrolyte. The small amount of fluid remaining on the wafer either forms droplets on a hydrophobic surface or a uniform thin coating on a hydrophilic surface. In both cases the fluid does not extend to the edge of the wafer if the optimized process is followed. This avoids the need to protect the chamber and the transport system from stray fluid. As the remaining fluid stays on the wafer the chamber design can be greatly simplified and as a consequence be more cost effective to manufacture. Film uniformity can be maintained even with an edge exclusion of about 2 mm by minimizing shadowing of the electric field close to the wafer surface. Through the use of a conical shaped seal a reliable fluid seal can be achieved as the seal will not fall out. Furthermore, with chambers of the invention the volume of space required to contain the chamber can be kept close to the volume of the cell. A shallow tilt of around 5° maintains a low volume whereas a 90° tilt would result in a chamber volume defined by a cube with greater than 300 mm sides when processing 300 mm wafers, which would offset some of the advantages associated with low volume changes.

Electrochemical deposition of metals or alloys other than copper, such as nickel, gold, indium, SnAg or SnPb, is possible using the present invention. Electrochemical polishing of suitable metals and alloys is also possible.

The invention claimed is:

1. An electrochemical deposition or polishing chamber including:

a support for a substrate, the support having an in-use position;

a housing having an interior surface and a fluid outlet pathway for removing an electrolyte from the chamber, wherein the fluid outlet pathway includes one or more slots which extend into the housing from at least one slotted opening formed in the interior surface, the interior surface includes an overhanging section, the slotted opening is formed in the overhanging section, and the slotted opening is formed so as to face downwardly into the chamber;

a seal for sealing the housing to a peripheral portion of a surface of a substrate positioned on the support in its in-use position;

a tilting mechanism for tilting the chamber by less than 10° in order to assist in removing electrolyte from the housing through the fluid outlet pathway; and an electrode disposed within the chamber and an electrode contact for contacting the substrate when the support is in its in-use position, in which, when the support is in its in-use position, the separation between the substrate and the electrode is less than 40 mm.

2. An electrochemical deposition or polishing chamber according to claim 1 in which the fluid outlet pathway includes a slot which is in communication with a slotted opening and extends generally upwardly therefrom.

3. An electrochemical deposition or polishing chamber according to claim 1 in which the housing includes a lower housing portion and an upper housing portion which are spaced apart to define at least one slot and, optionally, at least one slotted opening.

4. An electrochemical deposition or polishing chamber according to claim 3 in which the upper housing portion is a shroud member which is positioned over the lower housing portion.

5. An electrochemical deposition or polishing chamber according to claim 1 in which the seal is an annular seal having an outer surface which is downwardly inclined towards the interior of the chamber.

6. An electrochemical deposition or polishing chamber according to claim 5 in which the annular seal tapers to a sealing surface for sealing against the surface of the substrate.

7. An electrochemical deposition or polishing chamber according to claim 6 in which the sealing surface is an edge region formed at the intersection of two mutually inclined surfaces of the annular seal.

8. An electrochemical deposition or polishing chamber according to claim 5 in which the annular seal is funnel shaped.

9. An electrochemical deposition or polishing chamber according to claim 1 in which, in-use, the seal contacts the substrate at a level, and the slotted opening is disposed less than 5 mm above said level.

10. An electrochemical deposition or polishing chamber according to claim 1 in which the seal is disposed so that, in-use, the seal contacts a peripheral portion of the surface of the substrate which is less than 3 mm from an edge of the substrate.

11. An electrochemical deposition or polishing chamber according to claim 1 in which, when the support is in its in-use position, the separation between the substrate and the electrode is in the range 5 to 30 mm.

* * * * *